US008938338B2

(12) United States Patent
Sakurai et al.

(10) Patent No.: US 8,938,338 B2
(45) Date of Patent: Jan. 20, 2015

(54) SYSTEM FOR CONTROLLING CONSTRUCTION MACHINE

(75) Inventors: Kohei Sakurai, Hitachi (JP); Kotaro Shimamura, Mito (JP); Kazuo Fujishima, Tsuchiura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 13/985,970

(22) PCT Filed: Feb. 16, 2012

(86) PCT No.: PCT/JP2012/053655

§ 371 (c)(1),
(2), (4) Date: Aug. 16, 2013

(87) PCT Pub. No.: WO2012/114973

PCT Pub. Date: Aug. 30, 2012

(65) Prior Publication Data

US 2013/0317710 A1 Nov. 28, 2013

(30) Foreign Application Priority Data

Feb. 23, 2011 (JP) ..... 2011-037366

(51) Int. Cl.

| | |
|---|---|
| ***G06F 7/70*** | (2006.01) |
| ***E02F 9/20*** | (2006.01) |
| ***E02F 9/12*** | (2006.01) |
| ***E02F 9/26*** | (2006.01) |

(52) U.S. Cl.

CPC ..... *E02F 9/2025* (2013.01); *E02F 9/123* (2013.01); *E02F 9/2095* (2013.01); *E02F 9/268* (2013.01)

USPC ..... 701/50

(58) Field of Classification Search

USPC ..... 701/50

See application file for complete search history.

(56) References Cited

U.S. PATENT DOCUMENTS

| | | | | |
|---|---|---|---|---|
| 2008/0168714 | A1* | 7/2008 | Watanabe et al. | 49/349 |
| 2009/0037144 | A1* | 2/2009 | Nagafuchi et al. | 702/183 |
| 2010/0057292 | A1* | 3/2010 | Ishikawa et al. | 701/33 |
| 2010/0313556 | A1* | 12/2010 | Kim | 60/463 |
| 2011/0264337 | A1* | 10/2011 | Takanashi et al. | 701/50 |
| 2012/0004797 | A1* | 1/2012 | Baino et al. | 701/22 |
| 2013/0060412 | A1* | 3/2013 | Nakagawara et al. | 701/22 |

FOREIGN PATENT DOCUMENTS

| | | |
|---|---|---|
| JP | 7-48761 | 11/1995 |
| JP | 2008-248545 | 10/2008 |
| JP | 2010-24043 | 2/2010 |
| JP | 2010-133237 | 6/2010 |
| JP | 2010-155724 | 7/2010 |

* cited by examiner

*Primary Examiner* — Hussein A. Elchanti

(74) *Attorney, Agent, or Firm* — Antonelli, Terry, Stout & Kraus, LLP.

(57) ABSTRACT

To provide a system for controlling a construction machine, which can be implemented inexpensively, can detect a failure in any of pressure sensors, controllers, an inverter device, and an electric motor for swing, and can secure safety and required workability for an operator.

Redundant hydraulic pressure sensors 20, 21 provide input to a first controller 11 for calculating a swing command, and a second controller 22 provided in an inverter device 13 for controlling an electric motor 16 for swing. The second controller 2 detects an abnormality in any of the hydraulic pressure sensors 20, 21 and the first controller 11 by a process for determining the validity of a swing command signal, and allows the swing operation to continue by using a signal from the second hydraulic pressure sensor 21 when determination is made based on the contents of the abnormality that the electric motor 16 for swing can operate normally.

2 Claims, 14 Drawing Sheets

1A:FRONT DEVICE
1B:VEHICLE BODY
1a:BOOM
1b:ARM
1c:BUCKET
1d:UPPER REVOLVING STRUCTURE
1e:LOWER TRAVELING BODY

1A:FRONT DEVICE
1B:VEHICLE BODY
1a:BOOM
1b:ARM
1c:BUCKET
1d:UPPER REVOLVING STRUCTURE
1e:LOWER TRAVELING BODY

SYSTEM FOR CONTROLLING CONSTRUCTION MACHINE

TECHNICAL FIELD

The present invention relates to a system for controlling a construction machine. Particularly, it relates to a means for improving reliability in a system in which driving an electric motor mounted in a construction machine is operated remotely by pilot hydraulic pressure derived from an operating device operated by an operator.

BACKGROUND ART

A construction machine such as a hydraulic excavator in the background art is generally provided with hydraulic actuators such as hydraulic cylinders and hydraulic motors serving as actuators for driving movable portions in respective portions of the machine, and provided with an engine serving as a drive source for a hydraulic pump as a hydraulic source. Patent Document 1 has disclosed an operating device applied to a construction machine of this type. In the operating device, a required number of pilot type directional control valves are disposed between the hydraulic pump and the respective hydraulic actuators, and a pilot valve for supplying pilot hydraulic pressure to a pilot port of each directional control value in accordance with an operation amount of an operation lever operated by the operator is provided so that the pilot hydraulic pressure derived from the pilot valve is supplied to the pilot port of a predetermined one of the directional control valves corresponding to the operated operation lever, so as to change over the direction control valve and drive the hydraulic actuator corresponding to the directional control valve.

In addition, in recent years, for example, as described in Patent Document 2, there has been proposed a hybrid construction machine which uses hydraulic actuators and an electric motor together as actuators for driving respective portions of the machine, and which uses an engine and a power generator motor together as a source for driving a hydraulic pump, so that the fuel consumption of the engine can be improved and the exhaust gas amount and the noise level can be reduced. In most hybrid construction machines in the background art, hydraulic actuators are driven for excavation and traveling while an electric motor is used for performing operation for swinging a swing structure (for example, upperstructure in a hydraulic excavator).

Patent Document 2 has disclosed a technique in which both an operating unit for driving hydraulic actuators and an operating unit for driving an electric motor are constituted by hydraulic pilot operated valves, and pilot hydraulic pressure derived from each hydraulic pilot operated valve is converted into an electric signal by a pressure sensor and outputted to a control portion, from which a control signal for the electric motor is outputted, so that a feeling of operation on the operating unit operated by an operator when the hydraulic actuators are driven and a feeling of operation on the operating unit operated by the operator when the electric motor is driven can be standardized to cancel a feeling of strangeness given to the operator. In the case where such a control system for the electric motor is used, normal control for swinging a vehicle body is difficult when an abnormality occurs in any one of the pressure sensors, the control portion and the electric motor. Thus, it is likely that there may arise a disadvantage that the vehicle body swings with a velocity or a direction not intended by the operator. In order to avoid this disadvantage, Patent Document 2 also has disclosed a technique in which the pressure sensors for detecting the operation amounts of the hydraulic pilot operated valves are made redundant so that electric signals outputted from the respective pressure sensors can be compared in the control portion so as to stop the electric motor properly when an abnormality is detected.

CITATION LIST

Patent Literature

Patent Literature 1: Japanese Examined Utility Model Application Publication No. Hei-7-48761
Patent Literature 2: JP-A-2008-248545

SUMMARY OF INVENTION

Technical Problem

However, in the technique disclosed in Patent Document 2, the pressure sensors are made redundant (dual) while the control portion is not made redundant. When the control portion itself fails, it is difficult to control the swing of the swing structure because a proper control signal for the electric motor cannot be outputted. In addition, a similar problem also arises when the electric motor for driving the swing structure or an inverter device applied to control for driving the electric motor fails. Such a disadvantage can be prevented from occurring if all the pressure sensors, the control portion, the inverter device and the electric motor are made redundant. However, the cost of the construction machine increases correspondingly. It is therefore difficult to use such a solution in practice. Further, in a configuration in which the electric motor for driving the swing structure is stopped immediately when an abnormality occurs in any one of the pressure sensors, the control portion, the inverter device and the electric motor, the working efficiency deteriorates remarkably. Therefore, configuration which is made so that driving the swing structure can be continued as long as possible according to some contents of the abnormality is also necessary.

The invention has been accomplished to solve such problems inherent in the background art. An object of the invention is to provide a system for controlling a construction machine, which can be implemented inexpensively, which can prevent an electric motor from abnormally rotating even when any of pressure sensors, control portions, an inverter device and the electric motor fails, and which can suppress lowering of working efficiency.

Solution to Problem

In order to solve the foregoing problem, according to the invention, there is provided a system for controlling a construction machine, including: operating members which are operated by an operator for operating a hydraulic actuator and an electric actuator; hydraulic operation signal generating units which output hydraulic operation signals in accordance with operation directions and operation amounts of the operating members for operating the hydraulic actuator; electric operation signal generating units which output electric operation signals in accordance with operation directions and operation amounts of the operating members for operating the electric actuator; electric control units which receive the electric operation signals and output control signals for the electric actuator in accordance with the electric operation signals; and an inverter device which receives the control signals and outputs a drive signal for the electric actuator in accordance with the control signals; the system being characterized in that: the electric operation signal generating units and the electric control units are placed correspondingly to the operating members for operating the electric actuator respectively, the electric operation signals outputted from the electric operation signal generating units are supplied to the electric control units respectively and individually, and at least one of the electric control units compares values calculated based on the electric operation signals with the control signals and makes determination based on a result of the comparison as to whether an abnormality has occurred in any of the electric operation signal generating units and the electric control units or not.

With this configuration, the plurality of electric operation signal generating units and the plurality of electric control units are placed correspondingly to the operating members for operating the electric actuator, and one of the electric control units determines whether an abnormality occurs in any of the electric operation signal generating units and the electric control units or not. It is therefore possible to make the electric operation signal generating units and the electric control units redundant so that reliability of the system can be improved. In addition, when determination is made that an abnormality occurs, the electric control unit can output a control signal for stopping driving the electric actuator or output a control signal for keeping on driving the electric actuator, in accordance with the contents of the occurring abnormality. Thus, possible workability can be kept while safety of work is secured.

In addition, according to the invention, there is provided a system for controlling a construction machine in the aforementioned configuration, characterized in that: a controller for controlling the inverter device, which is additionally provided in the inverter device, is used as one of the electric control units.

With this configuration, the controller for controlling the inverter device is used effectively as a controller for controlling the electric actuator. Therefore, when the number of controllers in the system as a whole is two, it is not necessary to provide a new controller additionally. When the number of controllers in the system as a whole is three or more, the number of controllers to be added newly can be reduced by one. Thus, a high-functional system for controlling a construction machine can be implemented inexpensively.

In addition, according to the invention, there is provided a system for controlling a construction machine in the aforementioned configuration, characterized in that: the electric control unit which determines whether an abnormality has occurred or not calculates an upper limit value of the control signal from the electric operation signal supplied to the electric control unit, determines whether a sign of the upper limit value coincides with a sign of the control signal or not, and compares the upper limit value with the control signal outputted from another electric control unit than the electric control unit; and the electric control unit which determines whether an abnormality has occurred or not stops electric operation of the electric actuator when determination is made that the signs of the two signals compared do not coincide with each other or when determination is made that the control signal outputted from another electric control unit than the electric control unit is larger than the upper limit value.

The case where the signs of the two signals compared do not coincide with each other corresponds to the case where a swing structure is swinging in a direction that is not intended by an operator. On the other hand, the case where a control signal outputted from an electric control unit that does not determine whether an abnormality occurs or not is larger than the upper limit value corresponds to the case where the swing structure is swing at a higher velocity than a velocity intended by the operator. In such a situation, it is difficult to perform work safely. Therefore, the safety of the work can be secured by stopping driving the electric actuators. On the contrary, the case where the signs of the two signals compared coincide with each other and the upper limit value is larger than the control signal outputted from the electric control unit that does not determine whether an abnormality occurs or not corresponds to the case where the swing structure is swinging at a velocity equal to or lower than the velocity intended by the operator. In this case, there is no problem on the safety of the work. Thus, driving the electric actuators can be kept on to continue the work, so that the lowering of efficiency in the work can be prevented or suppressed.

In addition, according to the invention, there is provided a system for controlling a construction machine in the aforementioned configuration, characterized in that: the electric control unit which determines whether an abnormality has occurred or not calculates an upper limit value of the control signal from the electric operation signal supplied to the electric control unit, determines whether a sign of the upper limit value coincides with a sign of each of the electric operation signals or a sign of each of the control signals or not, and compares the upper limit value with the control signal outputted from another electric control unit than the electric control unit; and the electric control unit which determines whether an abnormality has occurred or not keeps on driving the electric actuator using the upper limit value when determination is made that the signs of the two signals compared coincide with each other and when determination is made that the control signal outputted from another electric control unit than the electric control unit is larger than the upper limit value.

When the signs of the two signals compared coincide with each other and a control signal outputted from an electric control unit that does not determine whether an abnormality occurs or not is larger than the upper limit value, the swing structure is swinging in a direction intended by an operator but at a higher velocity than a velocity intended by the operator. In such a situation, as described above, the safety of work can be secured by stopping driving the electric actuator but the workability deteriorates, on the other hand. Therefore, when the electric actuator is driven continuously so as to keep the target velocity of the swing structure at the upper limit value, the swing velocity of the swing structure can be set at a velocity equal to or lower than the velocity intended by the operator. Thus, the workability can be improved while the safety of work is secured.

In addition, according to the invention, there is provided a system for controlling a construction machine in the aforementioned configuration, characterized in that: the electric control unit which determines whether an abnormality has occurred or not calculates a differential value between the electric operation signal supplied to the electric control unit and the electric operation signal supplied to another electric control unit than the electric control unit, and compares the differential value with a predetermined reference value; and the electric control unit which determines whether an abnormality has occurred or not stops the electric operation of the electric actuator when determination is made that the differential value is larger than the reference value.

The situation where the differential value is larger than the reference value occurs corresponds to the case where any one of the electric operation signal generating units outputting the electric signals is damaged or the case where any one of the electric control units outputting the control signals is damaged. In such a case, safe swing of the swing structure cannot be secured. Therefore, the safety of work can be secured by stopping driving the electric actuator.

In addition, according to the invention, there is provided a system for controlling a construction machine, including: operating members which are operated by an operator for operating a hydraulic actuator and an electric actuator; hydraulic operation signal generating units which output hydraulic operation signals in accordance with operation directions and operation amounts of the operating members for operating the hydraulic actuator; electric operation signal generating units which output electric operation signals in accordance with operation directions and operation amounts of the operating members for operating the electric actuator; electric control units which receive the electric operation signals and output control signals for the electric actuator in accordance with the electric operation signals; and an inverter device which receives the control signals and outputs a drive signal for the electric actuator in accordance with the control signals; the system being characterized in that: the inverter device calculates a status signal indicating a real driving status of the electric actuator based on a position signal of the electric actuator, determines whether a sign of each of the control signals coincides with a sign of the status signal or not, further determines whether the control signal is larger than the status signal or not, and stops the electric operation of the electric actuator when determination is made that the sign of the control signal does not coincide with the sign of the status signal or when determination is made that the status signal is larger than the control signal.

With this configuration, whether an abnormality occurs or not is determined with reference to the status signal indicating the real driving status of the electric actuator. Accordingly, not only a failure in any of the electric operation signal generating units and the electric control units but also a failure in either of the electric actuator and the inverter device can be coped with, so that the reliability of the system for controlling the construction machine can be more enhanced.

In addition, according to the invention, there is provided a system for controlling a construction machine, including: operating members which are operated by an operator for operating a hydraulic actuator and an electric actuator; hydraulic operation signal generating units which output hydraulic operation signals in accordance with operation directions and operation amounts of the operating members for operating the hydraulic actuator; electric operation signal generating units which output electric operation signals in accordance with operation directions and operation amounts of the operating members for operating the electric actuator; electric control units which receive the electric operation signals and output control signals for the electric actuator in accordance with the electric operation signals; and an inverter device which receives the control signals and outputs a drive signal for the electric actuator in accordance with the control signals; the system being characterized in that: the inverter device includes a monitoring unit which monitors a status of the inverter device itself, and the monitoring unit calculates a status signal indicating a real driving status of the electric actuator based on a position signal of the electric actuator, determines whether a sign of each of the control signals coincides with a sign of the status signal or not, and further determines whether the control signal is larger than the status signal or not; and the electric operation of the electric actuator is stopped when determination is made that the sign of the control signal does not coincide with the sign of the status signal or when determination is made that the status signal is larger than the control signal.

With this configuration, the inverter device is provided with the monitoring unit so as to monitor the inverter device itself. Accordingly, a failure in the inverter device can be detected easily and surely. Since the monitoring unit does not calculate a control signal for the electric actuator, an inexpensive microcomputer or the like can be used as the monitoring unit so that there is no fear that the monitoring unit may cause the increase in the cost of the system for controlling the construction machine.

In addition, according to the invention, there is provided a system for controlling a construction machine, including: operating members which are operated by an operator for operating a hydraulic actuator and an electric actuator; hydraulic operation signal generating units which output hydraulic operation signals in accordance with operation directions and operation amounts of the operating members for operating the hydraulic actuator; electric operation signal generating units which output electric operation signals in accordance with operation directions and operation amounts of the operating members for operating the electric actuator; electric control units which receive the electric operation signals and output control signals for the electric actuator in accordance with the electric operation signals; and an inverter device which receives the control signals and outputs a drive signal for the electric actuator in accordance with the control signals; the system being characterized in that: each of the electric control units and the inverter device exchange monitoring signals with each other periodically, and determines whether each of the electric control unit and the inverter device has received a monitoring signal from the other within a predetermined period of time or not; when the inverter device determines that no monitoring signal has been received from the electric control unit within the predetermined period of time, the inverter device stops the electric operation corresponding thereto, or keeps on driving the electric actuator using an upper limit value of the control signal calculated from the control signal supplied to the inverter device; and when the electric control unit makes determination that no monitoring signal has been received from the inverter device within the predetermined period of time, the electric control unit stops the electric operation corresponding thereto.

With this configuration, each of electric control units and the inverter device transmit and receive monitoring signals to and from each other so that the electric control unit and the inverter device can monitor each other. Accordingly, a failure in any of the electric control units and the inverter device can be detected easily and surely. In addition, in this case which is different from the case where the inverter device monitors itself, it is not necessary to provide any special monitoring unit. Therefore, the system for controlling the construction machine can be implemented more easily and inexpensively.

In addition, according to the invention, there is provided a system for controlling a construction machine in any one of the aforementioned configurations, characterized in that: when determination is made that an abnormality occurs in any one of the electric actuator, the electric operation signal generating units, the electric control units and the inverter device, notification corresponding to contents of the occurring abnormality is given to an operator.

With this configuration, the operator can know the occurrence of an abnormality and the contents of the occurring abnormality in real time, so that the operator can cope with a failure in an early stage.

Advantageous Effects of Invention

The system for controlling the construction machine according to the invention can be implemented inexpensively in a simple configuration, can detect the occurrence of an abnormality in any of an electric actuator, pressure sensing units, electric control units and an inverter device, and can avoid an abnormal swing operation of a swing structure that is not intended by an operator.

DESCRIPTION OF EMBODIMENTS

Figure 1:
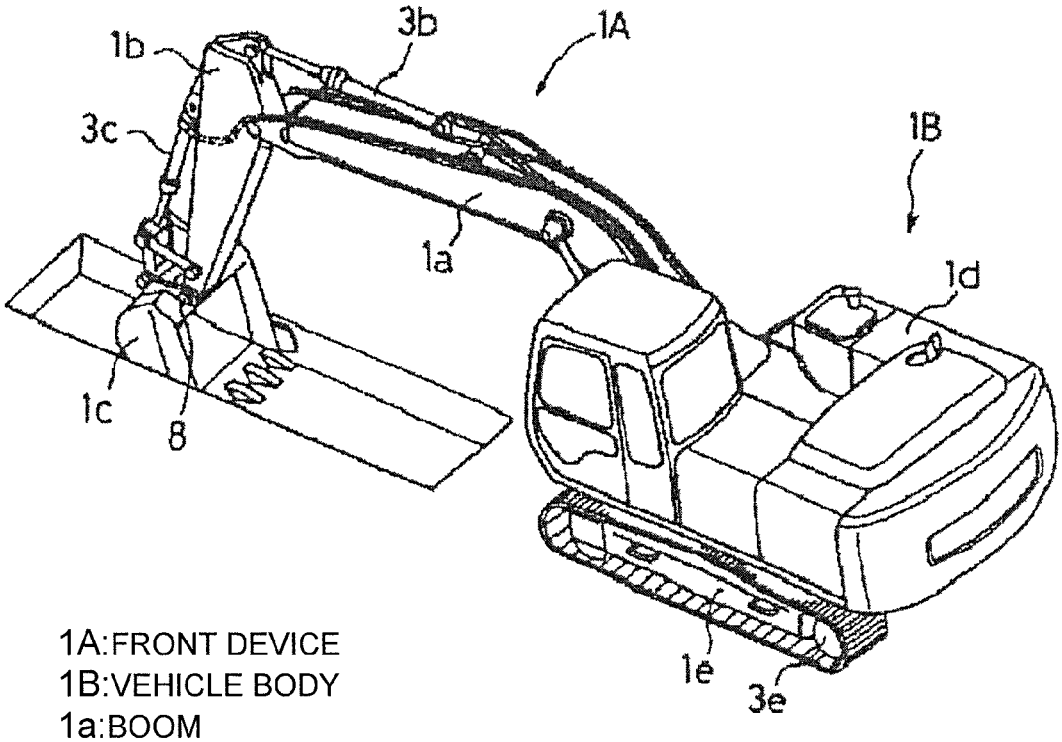
FIG. 1 An outline view of a hybrid excavator provided with a system for controlling a construction machine according to the invention.

Embodiments of a system for controlling a construction machine according to the invention will be described below with reference to the drawings. In the drawings, a first controller, a second controller, a third controller, a first hydraulic sensor and a second hydraulic sensor, which will be described below, are mentioned as a controller 1, a controller 2, a controller 3, a hydraulic sensor 1 and a hydraulic sensor 2 respectively.

As apparent from FIG. 1, an electric hydraulic excavator in this example is constituted by a multi-jointed front device 1A including a boom 1*a*, an arm 1*b* and a bucket 1*c*, and a vehicle body 1B including an upperstructure 1*d* and lower traveling bodies 1*e*. A base end of the boom 1*a* of the front device 1A is supported on a front portion of the upperstructure 1*d* so as to rotate vertically. The boom 1*a*, the arm 1*b*, the bucket 1*c*, the upperstructure 1*d* and the lower traveling bodies 1*e* are driven by a boom cylinder 3*a*, an arm cylinder 3*b*, a bucket cylinder 3*c*, an electric motor 16 for swing and left and right hydraulic motors 3*e* and 3*f* for traveling, respectively. These actuators are driven by an operator who operates operating members such as operation levers provided in operation signal generating devices 4*a* and 4*b*.

Figure 2:
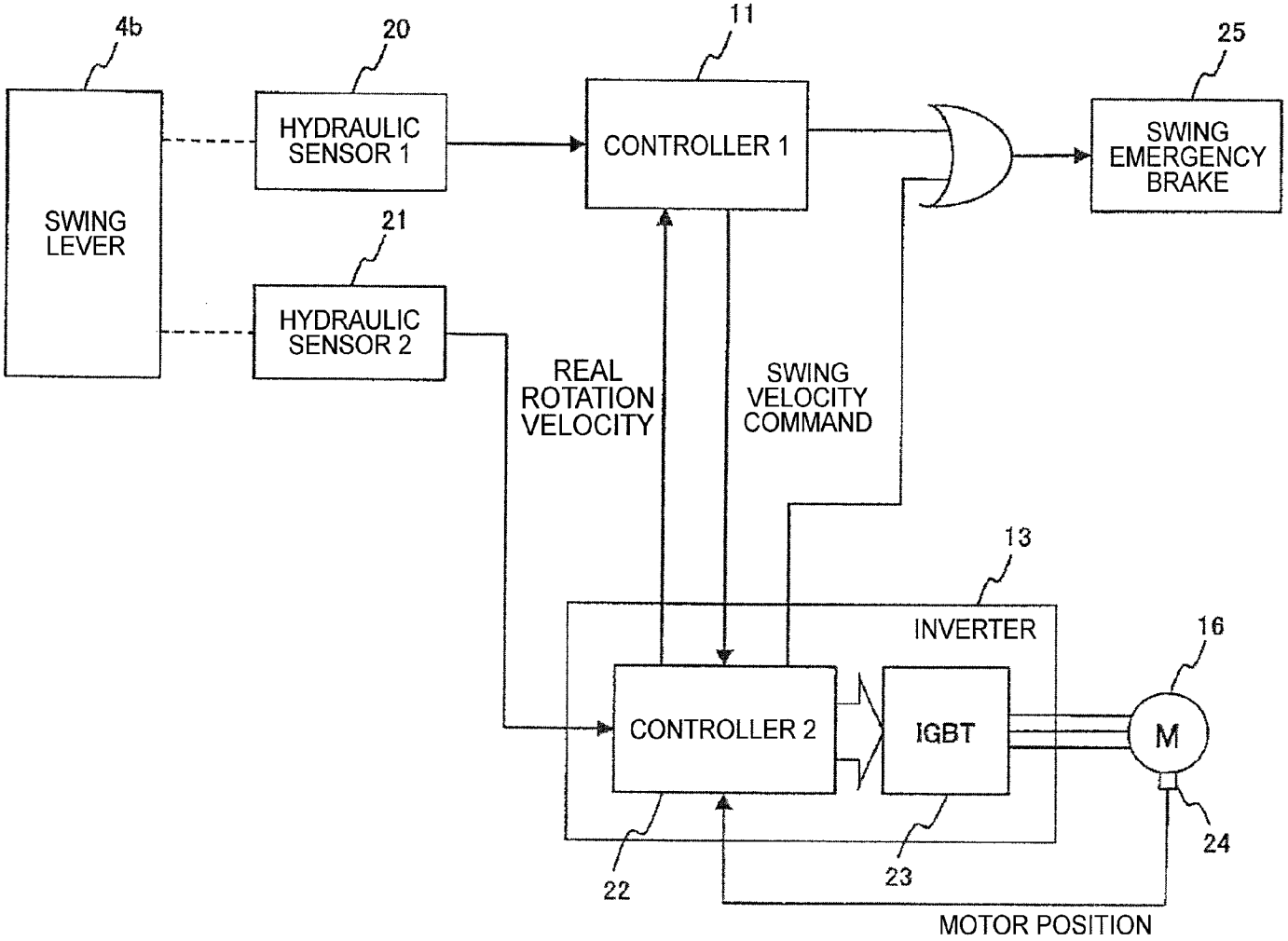
FIG. 2 A block diagram showing the configuration of a system for controlling a construction machine according to a first embodiment.

FIG. 2 is a diagram showing the configuration of a system for controlling a construction machine according to a first embodiment of the invention. As apparent from the drawing, the system for controlling a construction machine in this example is constituted by a swing operation signal generating device (hydraulic operation signal generating unit) 4*b* which derives pilot pressure in accordance with an operation direction and an operation amount of an operating member for swing operation such as an operation lever when the operator operates the operating member, and first and second hydraulic sensors (electric operation signal generating units) 20 and 21 each of which detects the pilot pressure derived from the swing operation signal generating device 4*b* and outputs an electric signal in accordance with the detected pilot pressure, a first controller (electric control unit) 11 which controls the swing of the upperstructure 1*d*, an inverter device 13 which drives the electric motor 16 for swing, and a swinging emergency brake 25. In addition, the inverter device 13 is constituted by an IGBT 23 which converts a not-shown DC voltage into an AC voltage to drive the electric motor 16 for swing, and a second controller 22 which controls on/off of the gate of the IGBT 23. Each of the hydraulic sensors 20 and 21 may be designed as a pair of two sensors for detecting leftward swing and rightward swing individually as will be described later. In FIG. 2, however, one hydraulic sensor is depicted for the sake of simplification. Although the first and second hydraulic sensors 20 and 21 each of which detects the pilot pressure derived from the swing operation signal generating device 4*b* and outputs an electric signal in accordance with the detected pilot pressure are used as electric operation signal generating units in this embodiment, this configuration may be replaced by position sensors or the like, each of which detects the operation position of an operation lever and outputs an electric signal in accordance with the detected operation position.

The electric signal outputted from the first hydraulic sensor 20 is inputted to the first controller 11, and the electric signal outputted from the second hydraulic sensor 21 is inputted to the second controller 22 additionally provided in the inverter device 13 and for the purpose of controlling the IGBT. The first controller 11 calculates a swing velocity command based on the electric signal outputted from the first hydraulic sensor 20 and a real swing/rotation velocity received from the second controller 22, and transmits the calculated swing velocity command to the second controller 22. The second controller 22 receives the swing velocity command. In order to satisfy the received swing velocity command, the second controller 22 controls on/off of the gate of the IGBT 23 based on a motor rotational position detection sensor 24 for detecting the rotational position of the electric motor 16 for swing, and a not-shown three-phase motor current.

Swing control executed by the system for controlling the construction machine according to the first embodiment will be described below schematically. In this embodiment, it is assumed that two or more failures do not occur concurrently in the first and second pressure sensors 20 and 21 and the first and second controllers 11 and 22.

First, the second controller 22 determines the validity of the swing velocity command received from the first controller 11 using the value of the electric signal outputted from the second hydraulic sensor 21. Thus, it is possible to detect the existence of an abnormality in any of the first and second hydraulic sensors 20 and 21 and the first controller 11. In addition, the second controller 22 determines the validity of a real swing/rotation velocity for the swing velocity command in order to detect a swing abnormality caused by a failure in the IGBT 23 or the electric motor 16 for swing or another abnormality than an abnormality in the swing control system. It can be also considered that the second controller 22 itself fails. This may be coped with by such a measure that the first controller 11 monitors the second controller 22 or the second controller 22 makes self-diagnosis internally. These measures will be described later in detail. According to the system for controlling the construction machine according to this embodiment, even when either of the first controller 11 and the second controller 22 detects an abnormality, the swing emergency brake 25 may be operated to stop abnormal swing that is not intended by the operator.

Although the swing velocity command is used as a command value from the first controller 11 in this embodiment, a swing torque command may be used. In this case, the second controller 22 feeds a real torque value back to the first controller 11.

Although the second controller 22 determines the validity of the swing velocity command received from the first controller 11 in this embodiment, this configuration may be replaced by a configuration in which an electric signal outputted from the first hydraulic sensor 20 is transmitted directly to the second controller 22 by the first controller 11, and the second controller 22 compares the electric signals outputted from the first and second hydraulic sensors 20 and 21, so that the existence of an abnormality in any of the first controller 11 and the first and second hydraulic sensors 20 and 21 can be detected.

Further, in this embodiment, the two hydraulic sensors 20 and 21 are provided for the swing operation signal generating device 4*b*. However, for example, a combination of sensors based on different detection methods, such as a combination of a hydraulic sensor and a position sensor for detecting an operation direction and an operation amount of an operation lever may be used. In this manner, the reliability of the system can be more improved.

Figure 3:
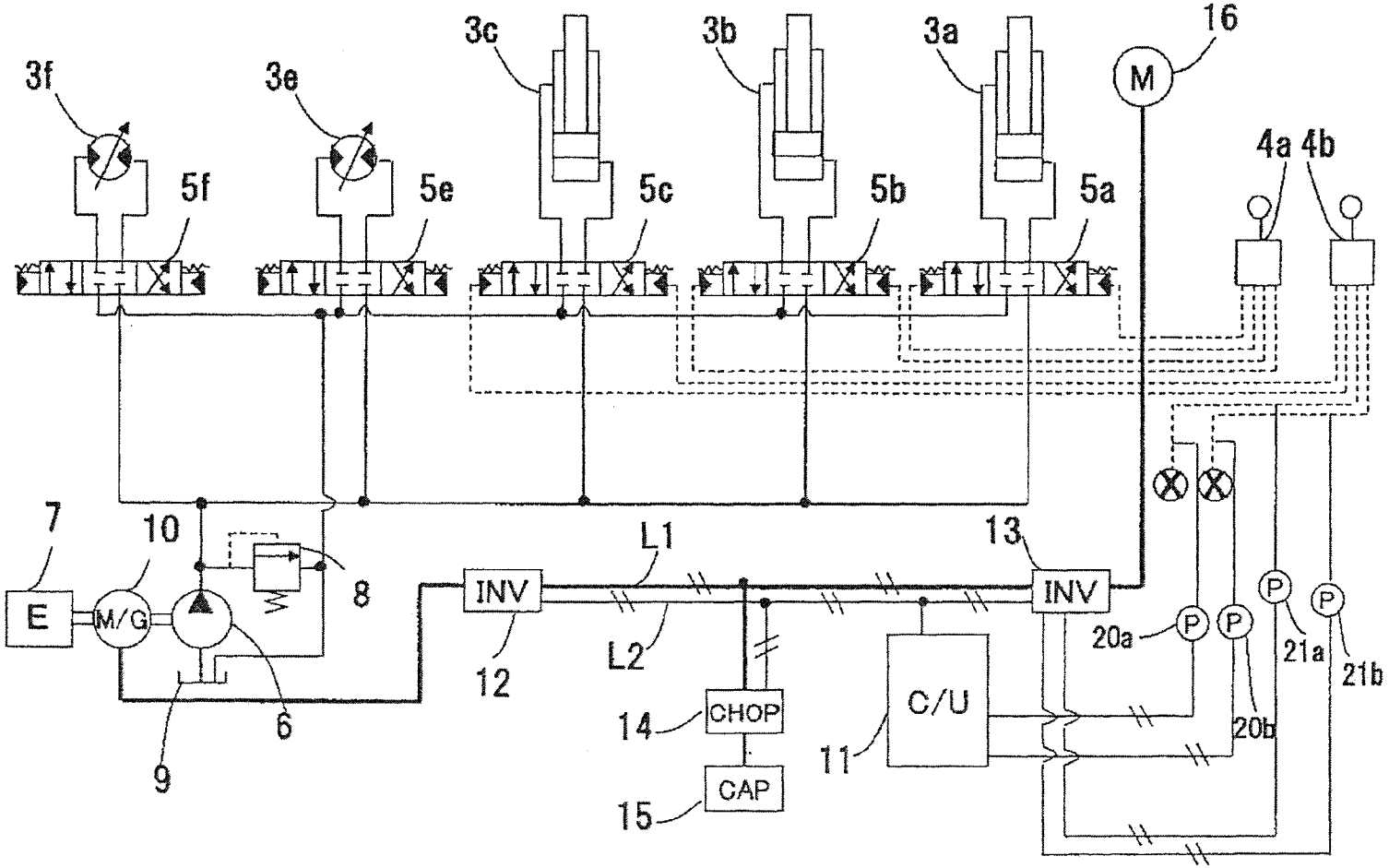
FIG. 3 A control circuit diagram of a hybrid excavator provided with the system for controlling the construction machine according to the first embodiment.

FIG. 3 shows a specific example in which the system for controlling the construction machine in this example is applied to a construction machine. When the operator operates an operating member such as an operation lever provided in each of operation signal generating devices 4*a* and 4*b*, the operation signal generating device 4*a*, 4*b* generates pilot pressure in accordance with an operation direction and an operation amount of the operation member. The pilot pressure is generated by reducing primary pressure generated in a not-shown pilot pump to secondary pressure corresponding to the operation opening position of the operation signal generating device 4*a*, 4*b*. The pilot pressure derived from the operation signal generating device 4*a* is sent to pressure reception portions of spool type direction changeover valves 5*a* to 5*f* so as to change over the direction changeover valves 5*a* to 5*f* from their illustrated neutral positions. The direction changeover valves 5*a* to 5*f* make control to change over the flow of hydraulic oil generated from a main hydraulic pump 6 powered by an engine 7, so as to control driving of the hydraulic actuators 3*a* to 3*f*. In this structure, when pressure in hydraulic pipe arrangement increases excessively, the hydraulic oil is let out to a tank 9 through a relief valve 8. The hydraulic actuators 3*a* to 3*c* are hydraulic cylinders for driving the boom 1*a*, the arm 1*b* and the bucket 1*c* respectively. The hydraulic actuators 3*e* and 3*f* are hydraulic motors for driving the left and right lower traveling bodies 1*e*.

A motive power converter 10 is linked between the hydraulic pump 6 and the engine 7. The motive power converter 10 serves as a power generator for converting the motive power of the engine 7 into electric energy and outputting the electric energy to the inverter devices 12 and 13 and as an electric motor for assist-driving the hydraulic pump 6 using electric energy supplied from an electric storage device 15. The inverter device 12 converts the electric energy of the electric storage device 15 into AC power and supplies the AC power to the motive power converter 10 so as to assist-drive the hydraulic pump 6.

The inverter device 13 supplies the electric power outputted from the motive power converter 10 to the electric motor 16 for swing. The inverter device 13 corresponds to the inverter device 13 shown in FIG. 2. Therefore, the inverter device 13 has the second controller 22 which is shown in FIG. 2, so that the inverter device 13 can receive a swing operation command signal from the first controller 11 and control driving of the swinging electric motor 16. In addition, the inverter device 13 determines the validity of the swing operation command signal from the first controller 11 based on electric signals inputted from second hydraulic sensors 21*a* and 21*b* connected to pilot pipe arrangement for controlling the leftward and rightward swing operations, of pilot pipe arrangement connecting the operation signal generating devices 4*a* and 4*b* and the direction changeover valves 5*a* to 5*f*.

A chopper 14 controls the voltage of a DC power line L1. The electric storage device 15 supplies electric power to the inverter devices 12 and 13 through the chopper 14, or stores electric energy generated by the motive power converter 10 or electric energy regenerated from the swing electric motor. A capacitor, a battery or the both can be used as the electric storage device.

The first controller 11 outputs a swing operation command signal for controlling driving of the swing electric motor 16 to the inverter device 13 based on the electric signals inputted from the second hydraulic sensors 20*a* and 20*b* connected to the pilot pipe arrangement for controlling the leftward and rightward swing operations, of the pilot pipe arrangement connecting the operation signal generating devices 4*a* and 4*b* and the direction changeover valves 5*a* to 5*f*. During the brake of swing, the first controller 11 also controls motive power regeneration for recovering electric energy from the electric motor 16 for swing. Further, during the control of motive power regeneration or when surplus electric power is generated due to a light hydraulic load, the first controller 11 also makes control to store the recovered electric power or the surplus electric power into the electric storage device 15.

The inverter devices 12 and 13, the chopper 14 and the controller 11 exchange signals required for control, through a communication line L2.

Figure 4:
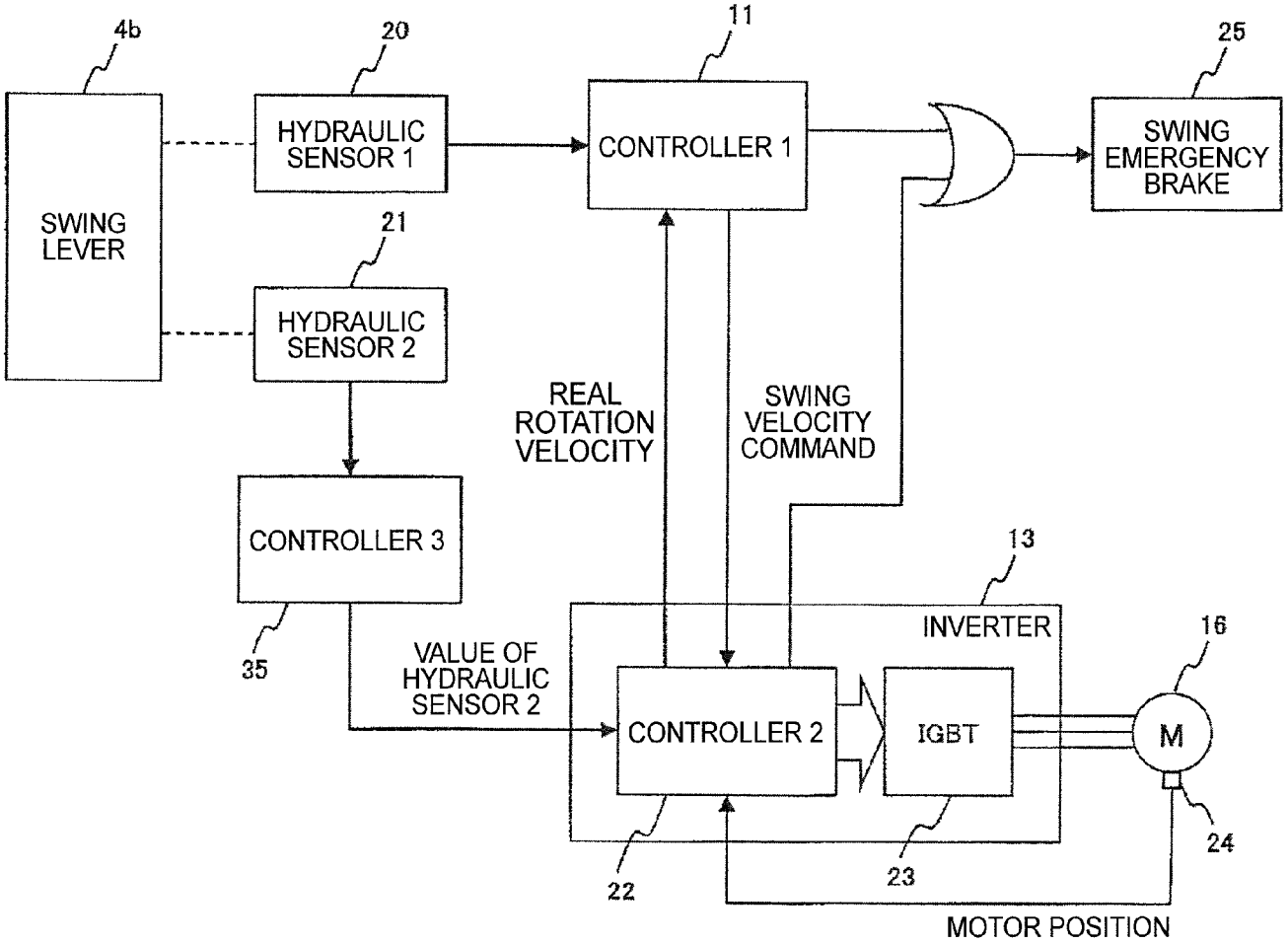
FIG. 4 A block diagram showing the configuration of a system for controlling a construction machine according to a second embodiment.

Next, a system for controlling a construction machine according to a second embodiment of the invention will be described with reference to FIG. 4. The system for controlling the construction machine in this example is characterized in that a third controller 35 is added to the system for controlling the construction machine according to the first embodiment.

An electric signal outputted from the second hydraulic sensor 21 is inputted to the third controller 35. The third controller 35 does not process the value of the second hydraulic sensor 21 but outputs the value of the second hydraulic sensor 21 directly to the second controller 22 provided in the inverter device 13. The second controller 22 provided in the inverter device 13 determines the validity of the swing operation command signal from the first controller 11 using the thus received output signal from the second hydraulic sensor 21.

Figure 5:
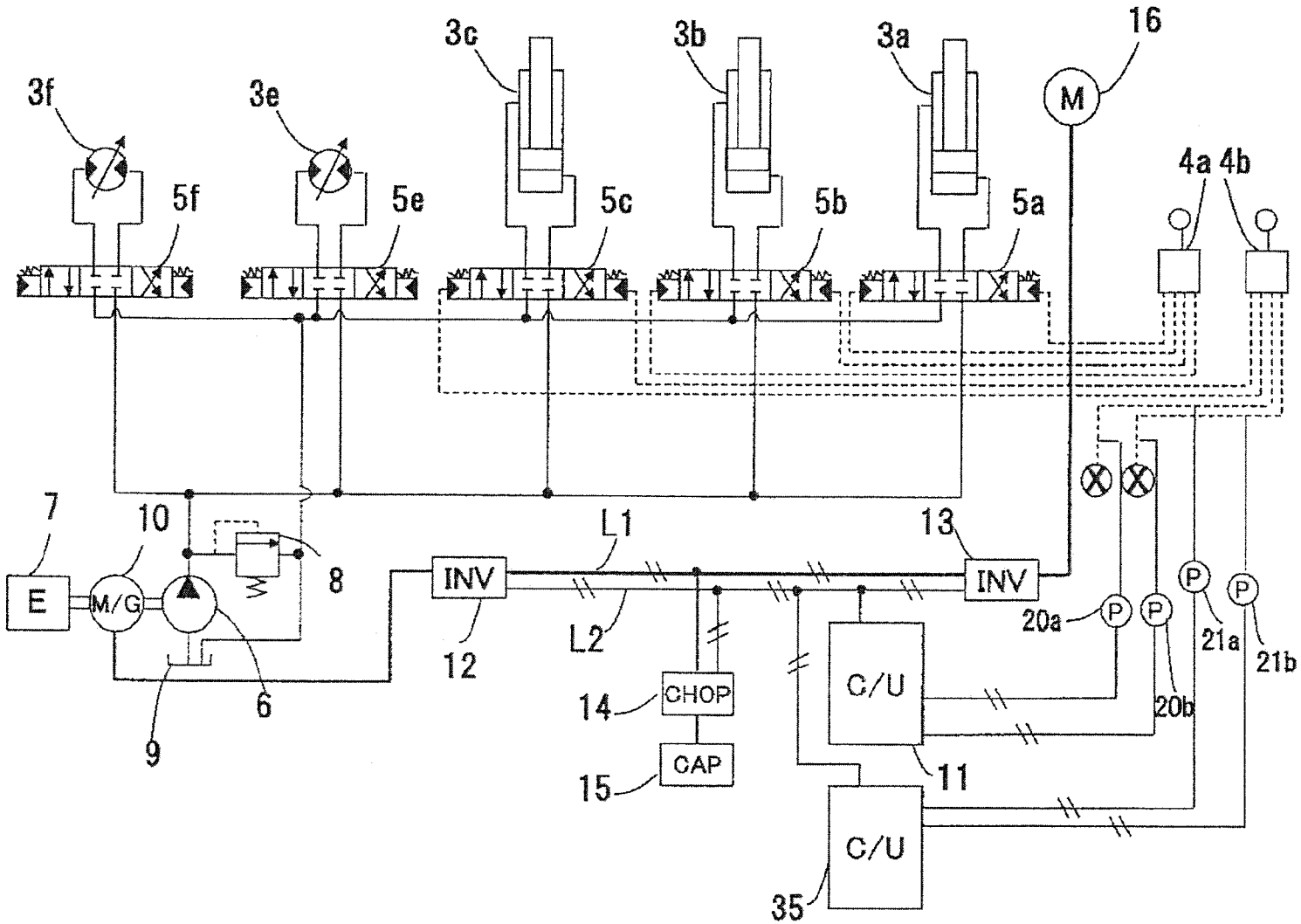
FIG. 5 A control circuit diagram of a hybrid excavator provided with the system for controlling the construction machine according to the second embodiment.

FIG. 5 shows a specific example in which the system for controlling the construction machine in this example is applied to a construction machine. In this embodiment, the third controller 35 is provided in addition to the first controller 11 which makes special control for the electric hydraulic excavator as shown in FIG. 3. Electric signals outputted from the hydraulic sensors 21*a* and 21*b* connected to the pilot pipe arrangement for controlling the leftward and rightward swinging operations, of the pilot pipe arrangement connecting the operation signal generating devices 4*a* and 4*b* and the direction changeover valves 5*a* to 5*f* are inputted to the third controller 35. For example, an engine controller, a machine controller for controlling the vehicle body as a whole, or the like may be used as the third controller 35. The inverter devices 12 and 13, the chopper 14 and the controllers 11 and 35 exchange signals required for control, through the communication line L2.

Next, processing for determining the validity of the swing command signal, which processing is executed by the system for controlling the construction machine according to the first and second embodiments will be described in detail with reference to FIGS. 6 to 9.

Figure 6:
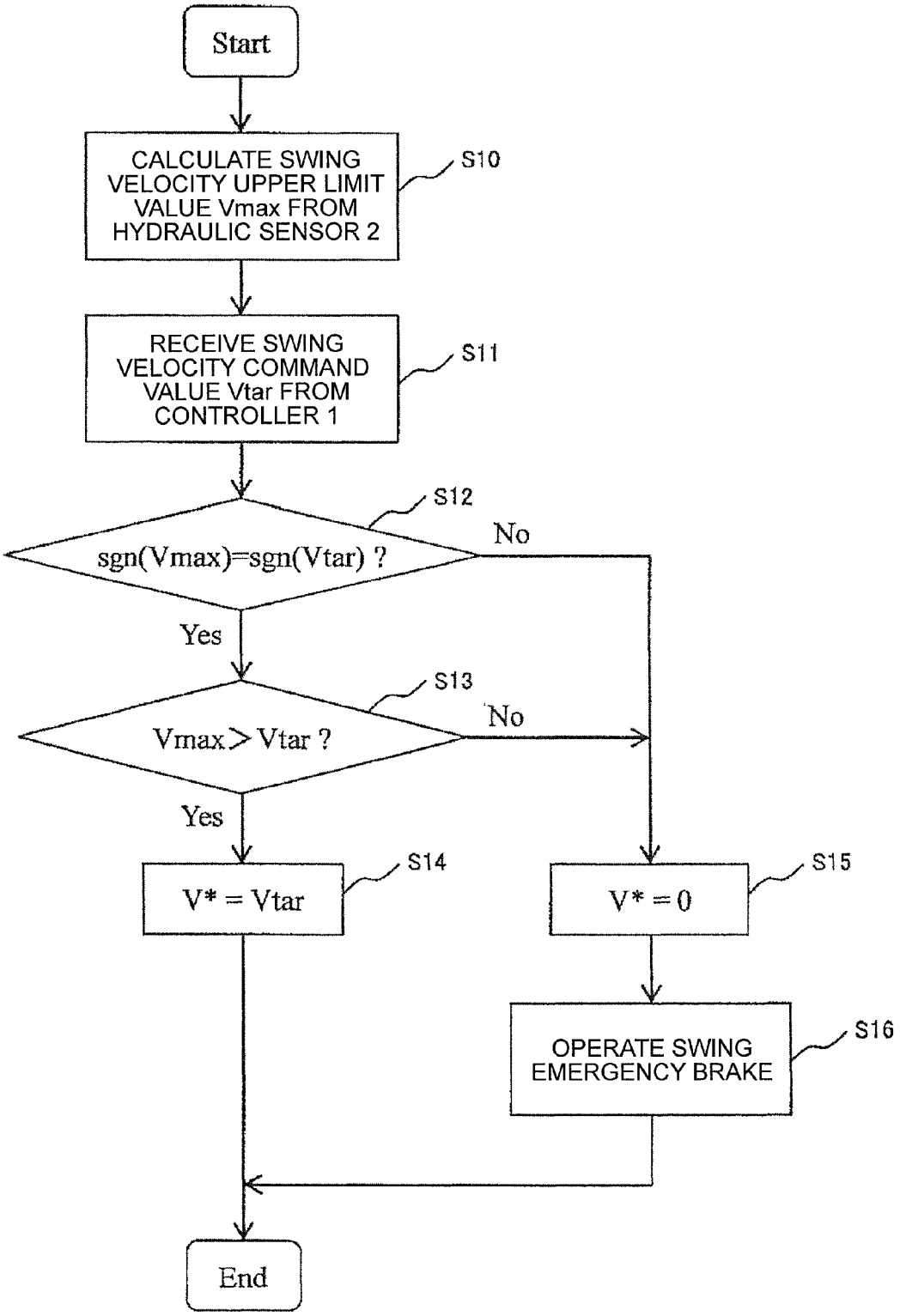
FIG. 6 A flow chart showing a procedure of processing for determining the validity of a swinging command signal, which procedure is executed by an internal controller of an inverter device.
Figure 7:
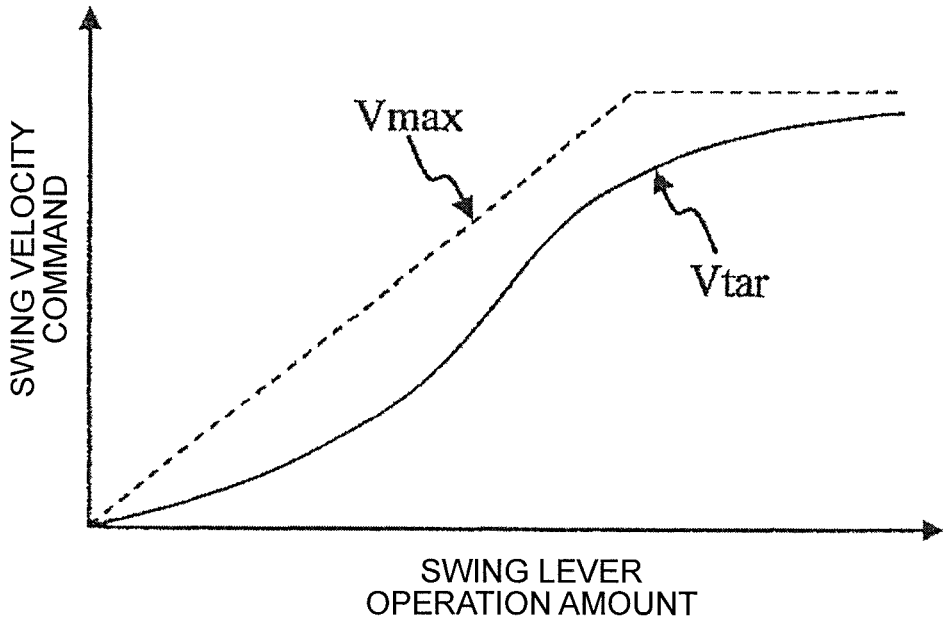
FIG. 7 A graph showing the relation between an upper limit value of a swing velocity with respect to an amount of operation on a swing lever calculated using a straight-line approximation expression, and a swing velocity command value calculated from the amount of operation on the swing lever.

FIG. 6 is a flow chart showing a first example of the processing for determining the validity of the swing command signal. First, in Step S10, a swing velocity upper limit value Vmax is calculated directly from the second hydraulic sensor 21 or using an output signal of the second hydraulic sensor 2 received from the third controller 35. In addition, in Step S11, a swing velocity command value Vtar is received from the first controller 11. Next, in Determination Step S12, determination is made as to whether the signs of the two values coincide with each other or not, that is, whether the swing directions calculated respectively by the controllers based on the values of the redundant hydraulic sensors coincide with each other or not. Here, sgn(a) means the sign of a value a. When determination is made that the signs of the two values coincide with each other, the flow of processing advances to Determination Step S13, in which determination is made as to whether the swing velocity command value Vtar falls within the swing velocity upper limit value Vmax or not.

The swing velocity upper limit value Vmax can be calculated from the output signal of the second hydraulic sensor 2 as described above. However, in order to reduce the calculation load on the second controller 22, a straight-line approximation expression for simplifying calculation as shown by the broken line in FIG. 7 may be programmed in advance based on the profile of the swing velocity command relative to the operation amount of the swing lever calculated in the first controller 11. Thus, the calculation load on the controller 2 can be reduced. It is a matter of course that if calculation resources allow, a map of the aforementioned profile may be provided, or the same swing control logic as that for the first controller 11 may be executed, so that the swing velocity command value can be compared directly.

Return to Determination Step S13 in FIG. 6, in which when determination is made here that Vmax>Vtar, determination can be made that the first and second hydraulic sensors 21 and 22 and the first controller 11 are normal. Therefore, Vtar is substituted into a final swing velocity target value V* in Step S14. Then, the processing for determining the validity of the swing command signal is terminated. When predetermined conditions are not satisfied in either of Determination Steps S12 and S13, determination can be made that there is an abnormality in any one of the first and second hydraulic sensors 21 and 22 and the first controller 11. Thus, control is made to stop the swing in accordance with a zero velocity command in Step S15, and the swing emergency brake is then operated in Step S16. Though not illustrated, the operator may be informed of the detection of an abnormality and urged to examine and repair the apparatus when the abnormality is detected.

Figure 8:
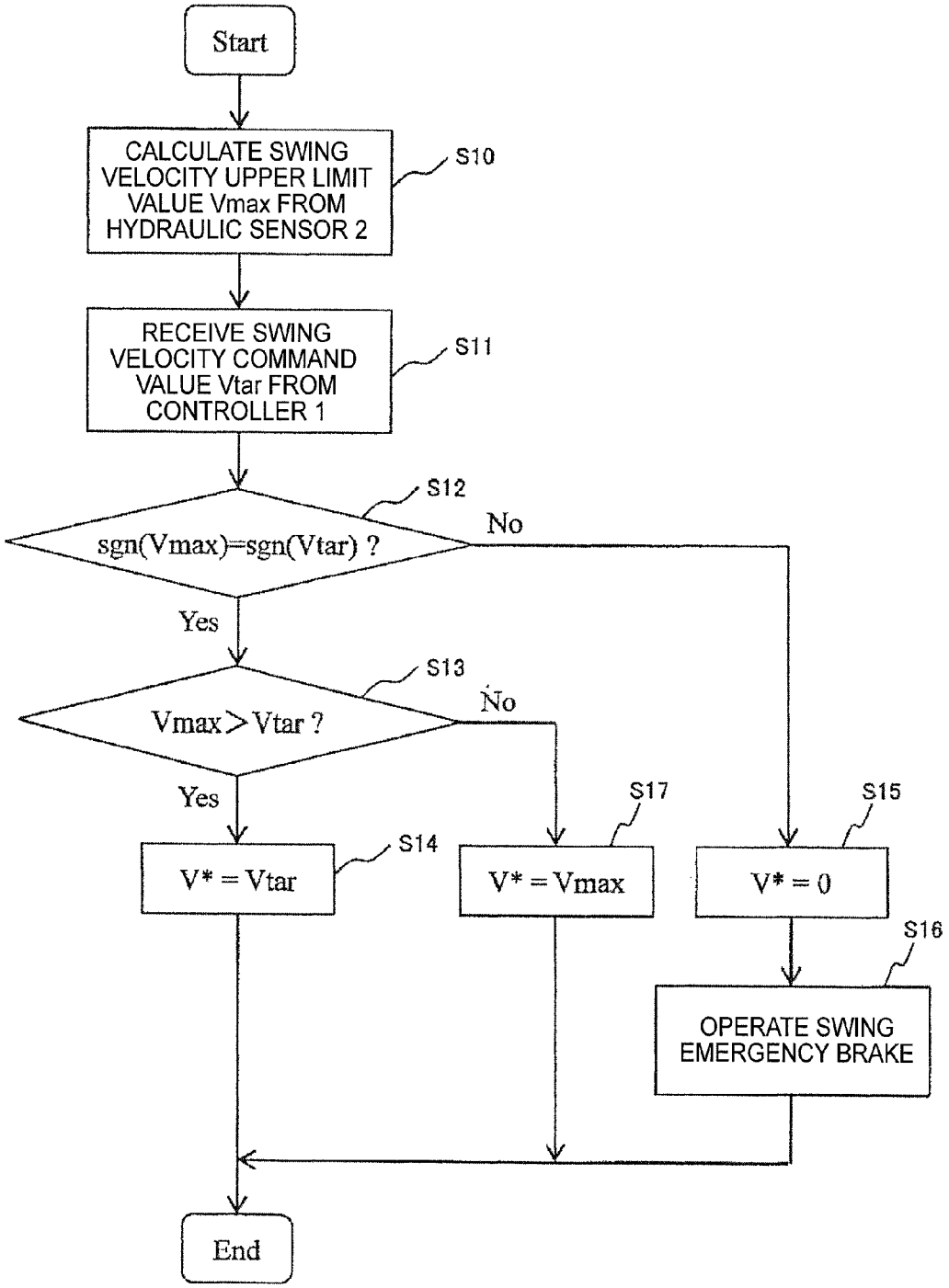
FIG. 8 A flow chart showing another example of the procedure of processing for determining the validity of a swing command signal, which procedure is executed by the internal controller of the inverter device.

FIG. 8 is a flow chart showing another example of the processing for determining the validity of the swing command signal. In this example, when Vmax>Vtar is not satisfied in Determination Step S13, determination can be made that there is an abnormality in any one of the first and second hydraulic sensors 21 and 22 and the first controller 11. Thus, the operator is informed of the abnormality, while Vmax is substituted into the final swing velocity target value V* in Step S17 so as to keep on the swing operation. In this manner, swing is not stopped even when an abnormality occurs. Thus, the availability of the construction machine can be improved. Incidentally, when the second hydraulic sensor 21 outputs an excessively small incorrect value due to a failure in the sensor 21, the swing performance is lowered but it does not lead to a dangerous event in which the velocity exceeds a velocity intended by the operator.

In Determination Step S13 in FIGS. 6 and 8, a failure in which an excessively large incorrect value is outputted in the second hydraulic sensor 21 may occur even if Vmax>Vtar is satisfied. In order not to leave the failure latent but to detect the failure, the following configuration may be arranged. That is, when the difference between Vmax and Vtar is not smaller than a predetermined threshold value, the difference is regarded as abnormal and the operator is informed of the abnormality and urged to examine and repair the apparatus.

Figure 9:
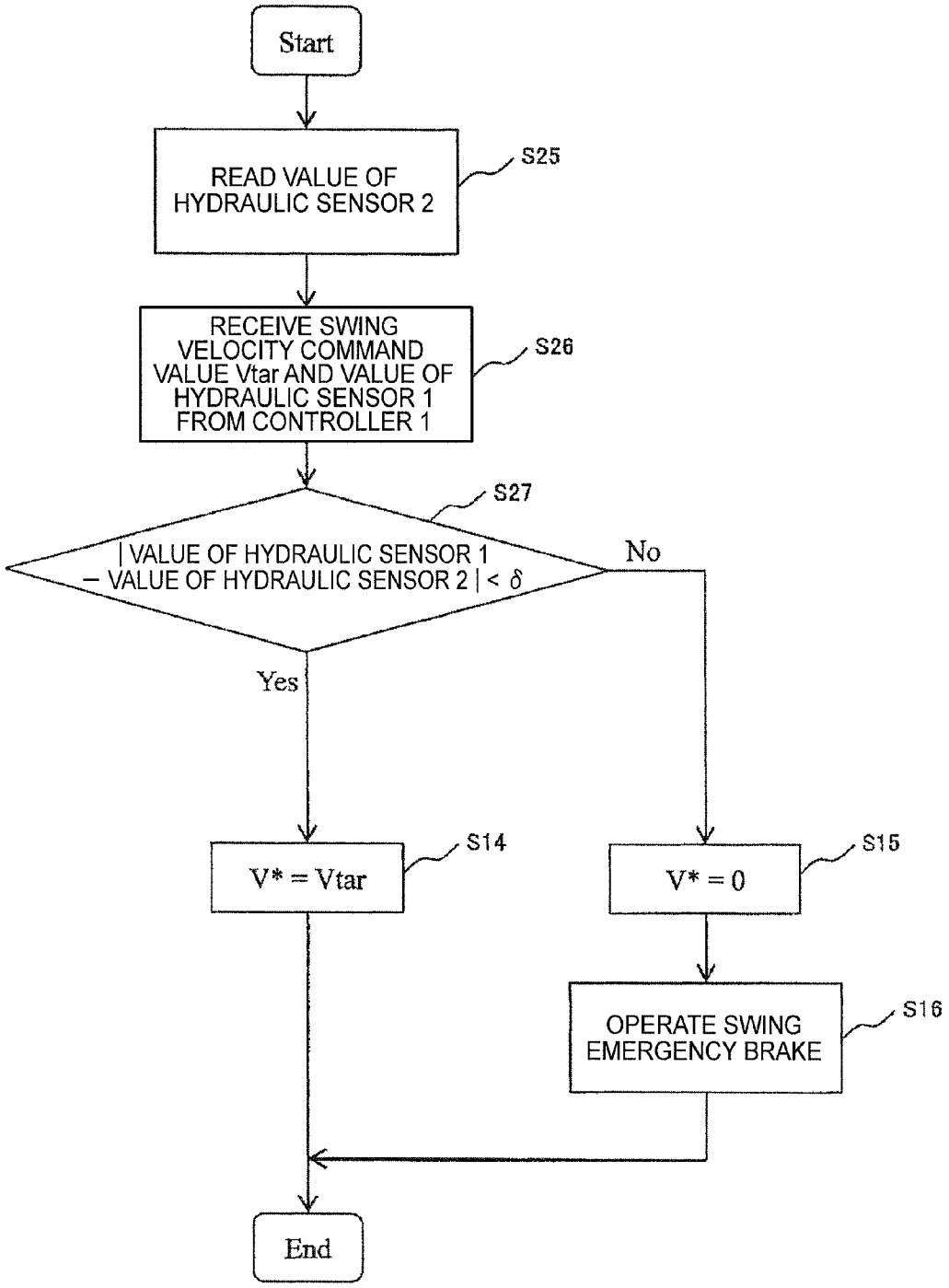
FIG. 9 A flow chart showing a procedure of abnormality detection executed by the internal controller of the inverter device directly comparing output signals of two hydraulic sensors.

FIG. 9 is a flow chart showing a further example of the processing for determining the validity of the swing command signal. In this example, the second controller 22 directly compares the electric signals outputted from the first and second hydraulic sensors 20 and 21, so as to detect an abnormality. First, the electric signal outputted from the hydraulic sensor 2 is read in Step S25, and the electric signal outputted from the first hydraulic sensor 20 and the swing velocity command value Vtar calculated based on the electric signal are received from the first controller 11 in Step S26. In the next Determination Step S27, the output signals of the hydraulic sensor 20 and the hydraulic sensor 21 are compared with each other. When the difference between the both is smaller than a predetermined given value 5, Vtar is substituted into the final swing velocity target value V* in Step S14. Then, the processing is terminated. On the contrary, when the difference between the both is not smaller than 5, control is made to stop the swing in accordance with a zero velocity command in Step S15, and the swing emergency brake is then operated in Step S16.

Next, with reference to FIGS. 10 and 11, description will be made on processing for determining the validity of a real swing rotation velocity for a swing velocity command in the system for controlling the construction machine according to the aforementioned first and second embodiments, so as to detect a swing abnormality caused by a failure in the IGBT 23 or the electric motor 16 for swing or another abnormality than an abnormality in the swing control system.

Figure 10:
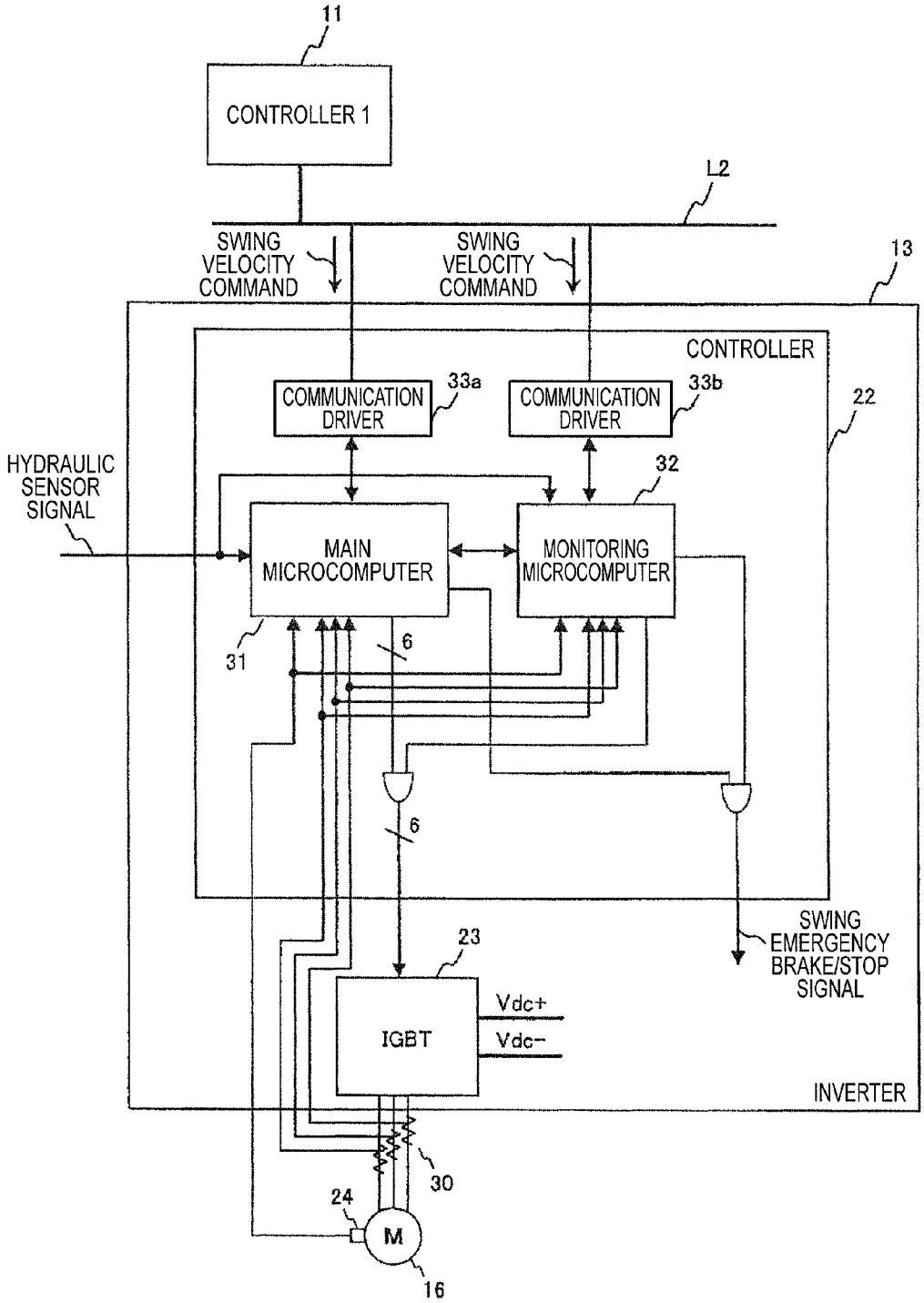
FIG. 10 A detailed block diagram of the inverter device provided in the system for controlling the construction machine according to an embodiment.

FIG. 10 is a detailed block diagram of the inverter device 13. As shown in this drawing, the second controller 22 is constituted by a main microcomputer 31, a monitoring microcomputer 32, and communication driver circuits 33*a* and 33*b* serving as interfaces to the communication line L2 for the microcomputers respectively. The main microcomputer 31 outputs a gate control signal for the IGBT 23 using information of the motor rotational position detection sensor 24 for detecting the rotational position of the electric motor 16 for swing and information of a three-phase current sensor 30, so as to satisfy the swing velocity command received from the first controller 11 through the communication line L2. Though not shown, the IGBT 23 includes a gate driver circuit for driving the gate.

Figure 11:
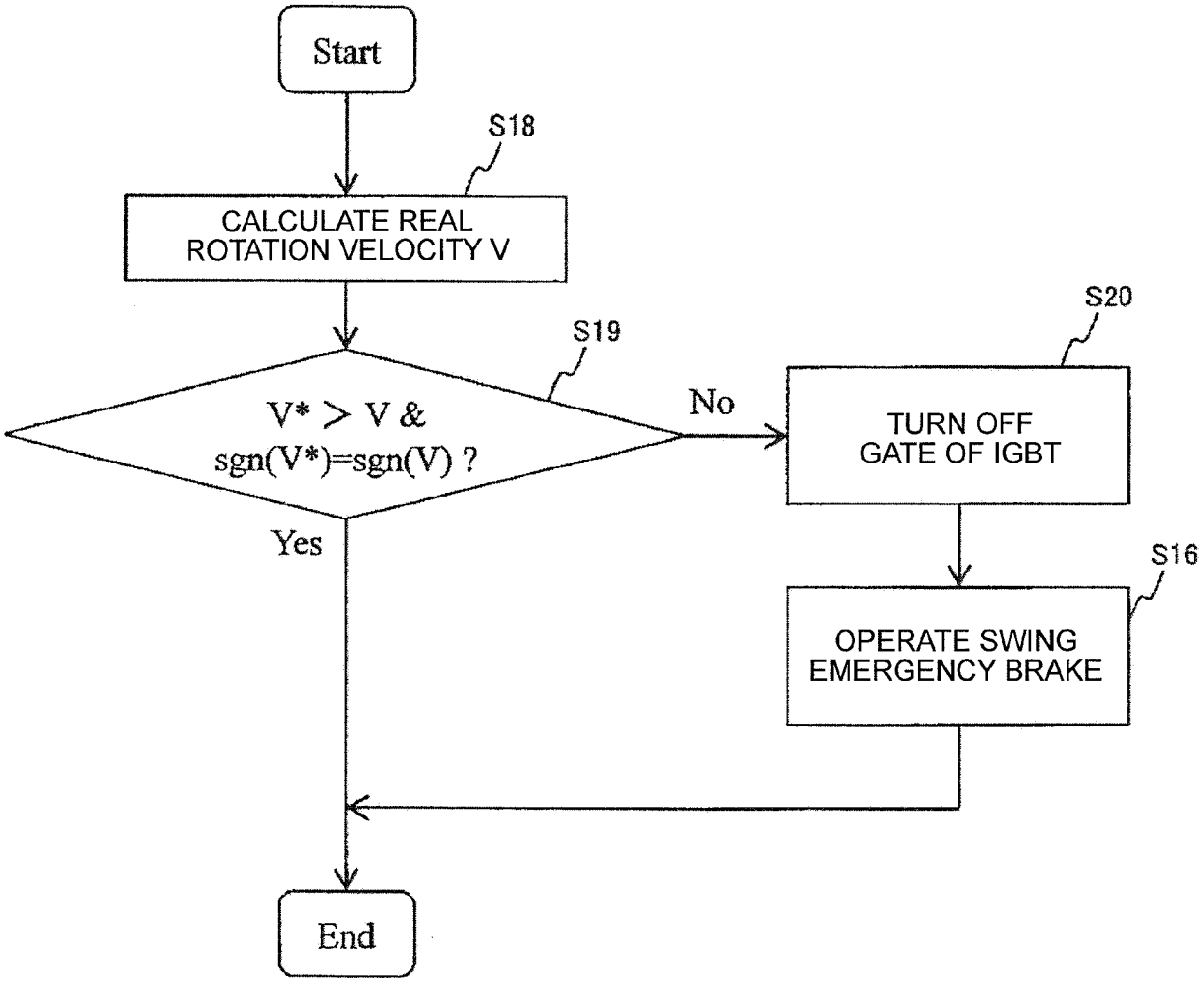
FIG. 11 A flow chart showing a procedure of processing for determining the validity of a real swinging rotational velocity with respect to a swinging velocity command, which procedure is executed by the internal controller of the inverter device.

The main microcomputer 31 executes processing for determining the validity of output as shown in FIG. 11 in order to detect an abnormality, as well as normal motor feedback control. First, in Step S18, a swing/rotation velocity V really outputted is calculated using an output signal value from the motor rotational position detection sensor 24. Next, in Determination Step S19, determination is made as to whether the swing/rotation velocity V is smaller than the aforementioned final swing velocity target value V*, that is, whether abnormal excess in rotation velocity occurs or not. Further, determination is made as to whether the signs of the two values coincide with each other, that is, whether reverse rotation to rotation intended by the operator occurs or not. When the criteria are not satisfied, determination can be made that the IGBT 23 or the electric motor 16 for swing fails or an abnormality occurs in another place than the swinging control system. There is a high possibility that it is not possible to issue a zero velocity command to make control to apply brake when any of such abnormalities occurs. Therefore, in Step S20, a gate off signal of the IGBT 23 is outputted to bring the electric motor 16 for swing into a free run state, and the swing emergency brake is then operated in Step S16. Also in this case, the operator may be informed of the detection of the abnormality and urged to examine and repair the apparatus when the abnormality is detected. Incidentally, in this embodiment, the validity of the output is determined based on comparison between the swing velocity command and the real swing velocity. However, in another embodiment, a swing torque command or a torque target value calculated from the swing velocity command may be compared with real torque calculated from a motor current.

Return to FIG. 10. The second controller 22 is provided with the monitoring microcomputer 32 as a self-diagnosis function for detecting an abnormality in the main microcomputer 31. The monitoring microcomputer 32 receives the swing velocity command through the communication line L2 and receives signals from the motor rotational position detection sensor 24 and the three-phase motor current sensor 30, in the same manner as the main microcomputer 31. The monitoring microcomputer 32 executes the processing for determining the validity of the output using these signals as shown in FIG. 11. When an abnormality is detected, an IGBT gate off signal and a swing emergency brake/stop signal are also outputted from the monitoring microcomputer 32. Thus, for example, even if the main microcomputer 31 goes out of control and makes incorrect motor control, the swing operation can be stopped. The monitoring microcomputer 32 does not make motor control. Therefore, the monitoring microcomputer 32 does not require as high computing performance as the main microcomputer 31. Thus, an inexpensive microcomputer can be used as the monitoring microcomputer 32. As a result, the system for controlling the construction machine in this example can be also implemented inexpensively totally.

In addition to the aforementioned processing, the monitoring microcomputer 32 may monitor the state of the main microcomputer 31 by combination of an example calculation method etc. in which the monitoring microcomputer 32 issues suitable questions to the main microcomputer 31 and diagnoses the main microcomputer 31 based on the result of answers to the questions. In FIG. 10, a communication function is also provided in the monitoring microcomputer 32 so that the monitoring microcomputer 32 can receive the swing velocity command directly from the first controller 11. However, if the monitoring microcomputer 32 is designed to receive the swing velocity command via the main microcomputer 31, the communication function can be removed from the monitoring microcomputer 32, so that the system can be configured more inexpensively. In such a configuration, the first controller 11 may be designed to send the command value with a check code or a serial number added thereto in advance, in order to prevent an abnormality in the main microcomputer 31 from being not able to be detected due to a wrong command value received by the monitoring microcomputer 32 when the abnormality occurs in the main microcomputer 31. When the main microcomputer 31 does not apply any processing to the command value but sends the command value directly to the monitoring microcomputer, the monitoring microcomputer 32 can determine whether the command value is tampered due to the abnormality in the main microcomputer 31 or not.

Detection of an abnormality in either of the controllers 11 and 22 may be carried out in another embodiment than the embodiments which have been described so far. That is, the detection may be carried out by mutual monitoring between the first controller 11 and the second controller 22.

Figure 12:
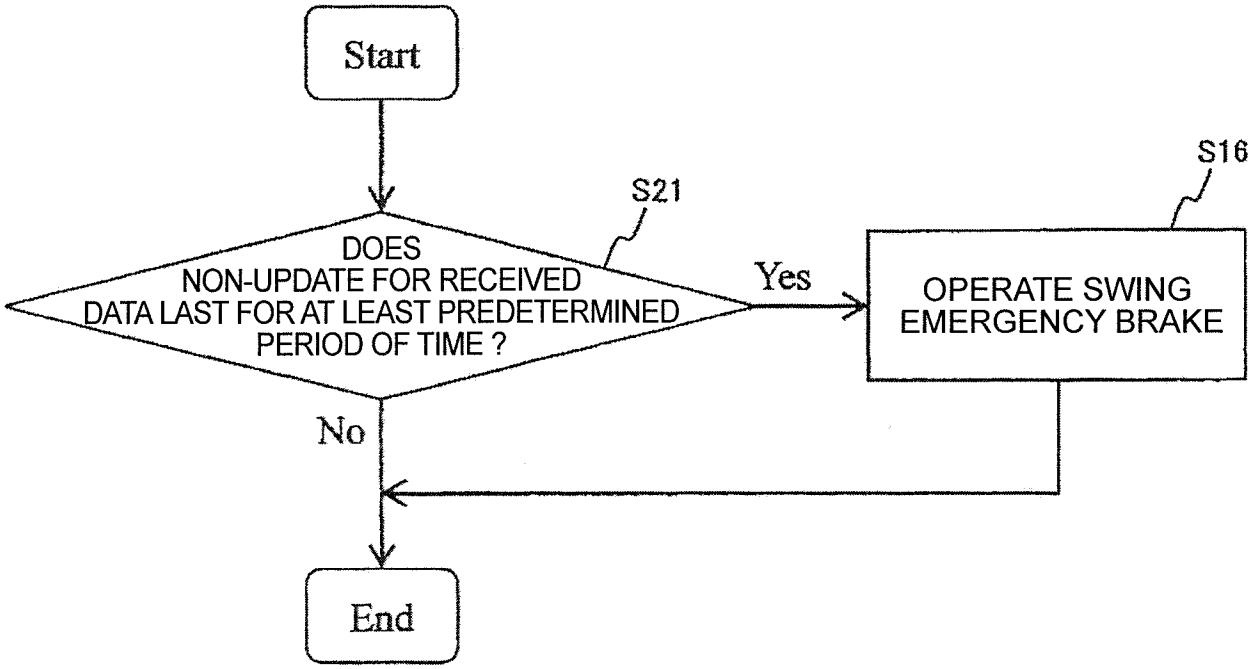
FIG. 12 A flow chart showing a procedure of processing for mutual monitoring, which procedure is executed by a main controller.

FIG. 12 is a flow chart showing a first example of processing for mutual monitoring between the controllers 11 and 22. In this example, the first controller 11 and the second controller 22 send and receive the command value and a feedback value thereof through the communication line L2. In Determination Step S21, the first controller 11 determines whether data received from the second controller 22 are updated within a predetermined period of time or not. When the data are not updated, determination can be made that an abnormality occurs in either the second controller 22 or the communication line L2. Due to the abnormality, in any case, swing cannot be kept on in accordance with the command. Therefore, the swing emergency brake is operated in Step S16. Also in this case, the operator is informed of the abnormality and urged to examine and repair the apparatus as described previously when the abnormality is detected.

Figure 13:
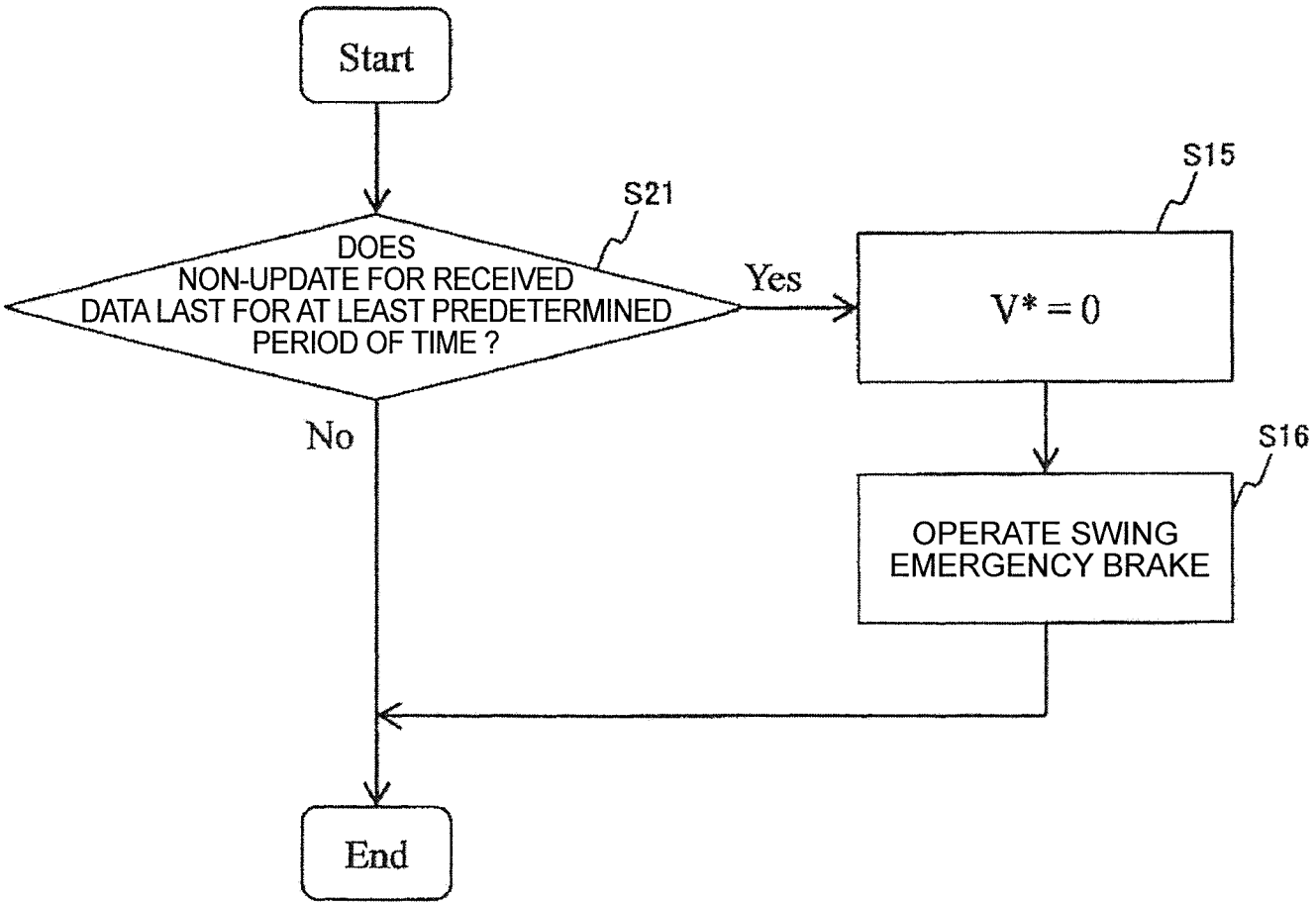
FIG. 13 A flow chart showing a procedure of processing for mutual monitoring, which procedure is executed by the internal controller of the inverter device.

FIG. 13 is a flow chart showing a second example of the processing for mutual monitoring between the controllers 11 and 22. In this example, when determination is made in Determination Step S21 that the data received from the controller 1 are not updated within the predetermined period of time, the motor control itself can be carried out normally. Therefore, control is made to stop swing in accordance with the zero velocity command in Step S15, and the swing emergency brake is then operated in Step S16.

Figure 14:
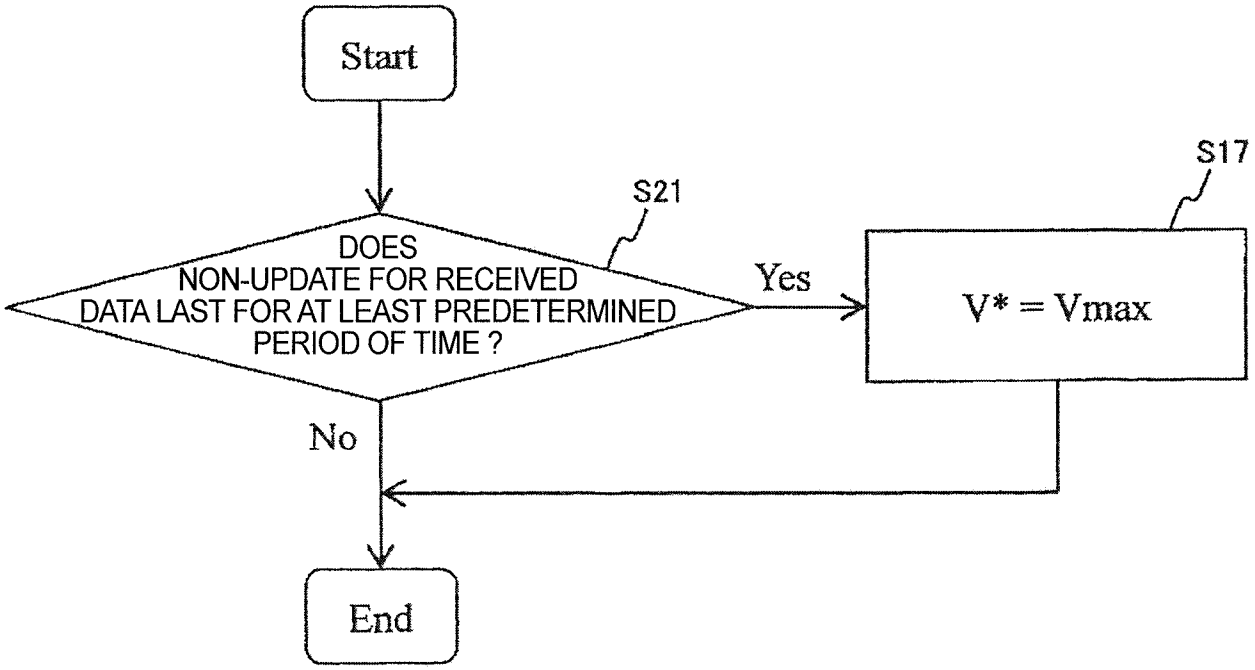
FIG. 14 A flow chart showing another example of the procedure of processing for mutual monitoring, which procedure is executed by the internal controller of the inverter device.

FIG. 14 is a flow chart showing a third example of the processing for mutual monitoring between the controllers 11 and 22. In this example, when determination is made in Determination Step 21 that data received from the first controller 11 are not updated within a predetermined period of time, the operator is informed of the abnormality. However, the motor control itself can be carried out normally. Therefore, Vmax calculated using the signal of the hydraulic sensor 2 by the second controller 22 is substituted into the final swing velocity target value V* in Step S17 so as to keep on the swing operation, as described previously. In this manner, swing is not stopped even when an abnormality occurs. Thus, the availability of the construction machine can be improved.

Incidentally, in addition to the swing command or the feedback value thereof, alive signals for reporting normal operations mutually and periodically may be used as reception data for confirming the existence of update in the aforementioned mutual monitoring processing.

As described above, according to the system for controlling the construction machine according to the invention, output signals from the redundant hydraulic sensors 20 and 21 are supplied to the first controller 11 for calculating a swing command and the second controller 22 provided in the inverter device 13 for controlling the electric motor 16 for swing. The second controller 22 executes processing for determining the validity of the swing command signal. Thus, an abnormality occurring in any of the hydraulic sensors 20 and 21 and the first controller 11 can be detected, so that an abnormal swing operation that is not intended by an operator can be avoided. When processing for determining the validity of an output for the swing command, self-diagnosis using the monitoring microcomputer, or mutual monitoring between the controllers 11 and 12 is performed in addition to the processing for determining the validity of the swing command signal, safety in the electric swing portion can be secured inexpensively without making each controller redundant even during a failure in any one of the hydraulic sensors 20 and 21, the controllers 11 and 22, the inverter device 13 and the electric motor 16 for swing. Further, one of the redundant hydraulic sensors provides input to the inverter device 13 so that an abnormality occurring in the first controller 11 for calculating the swing command or a communication line connecting the controller 11 and the inverter device 13 can be also detected. In addition, when an abnormality of this type is detected, swing the swing structure is kept on, so that the availability of the construction machine can be improved.

REFERENCE SIGNS LIST

1A . . . front device, 1B . . . vehicle body, 1*a* . . . boom, 1*b* . . . arm, 1*c* . . . bucket, 1*d* . . . upperstructure, 1*e* . . . lower traveling body, 3*a* . . . boom cylinder, 3*b* . . . arm cylinder, 3*c* . . . bucket cylinder, 3*e* . . . left traveling motor, 3*f* . . . right traveling motor, 4*a*, 4*b* . . . operating device, 5*a*-5*f* . . . spool type direction changeover valve, 6 . . . hydraulic pump, 7 . . . engine, 8 . . . relief valve, 9 . . . hydraulic oil tank, 10 . . . motive power converter, 11 . . . first controller, 12,13 . . . inverter device, 14 . . . chopper, 15 . . . electric storage device, 16 . . . electric motor for swing, 20 . . . first hydraulic sensor, 20*a* . . . first hydraulic sensor (left side), 20*b* . . . first hydraulic sensor (right side), 21 . . . second hydraulic sensor, 21*a* . . . second hydraulic sensor (left side), 21*b* . . . second hydraulic sensor (right side), 22 . . . second controller, 23 . . . IGBT, 24 . . . motor rotational position detection sensor, 25 . . . swing emergency brake, 30 . . . three-phase motor current sensor, 31 . . . main microcomputer, 32 . . . monitoring microcomputer, 33*a*,33*b* . . . communication driver, L1 . . . DC power line, L2 . . . communication line

The invention claimed is:

1. A system for controlling a construction machine, comprising: operating members which are operated by an operator for operating a hydraulic actuator and an electric actuator; hydraulic operation signal generating units which output hydraulic operation signals in accordance with operation directions and operation amounts of the operating members for operating the hydraulic actuator; electric operation signal generating units which output electric operation signals in accordance with operation directions and operation amounts of the operating members for operating the electric actuator; electric control units which receive the electric operation signals and output control signals for the electric actuator in accordance with the electric operation signals; and an inverter device which receives the control signals and outputs a drive signal for the electric actuator in accordance with the control signals; wherein:

the inverter device calculates a status signal indicating a real driving status of the electric actuator based on a position signal of the electric actuator, determines whether a sign of each of the control signals coincides with a sign of the status signal or not, further determines whether the control signal is larger than the status signal or not, and stops the electric operation of the electric actuator when determination is made that the sign of the control signal does not coincide with the sign of the status signal or when determination is made that the status signal is larger than the control signal.

2. A system for controlling a construction machine according to claim 1, wherein:

the inverter device includes a monitoring unit which monitors a status of the inverter device itself; and the monitoring unit calculates a status signal indicating a real driving status of the electric actuator based on a position signal of the electric actuator, determines whether a sign of each of the control signals coincides with a sign of the status signal or not, further determines whether the control signal is larger than the status signal or not, and stops the electric operation of the electric actuator when determination is made that the sign of the control signal does not coincide with the sign of the status signal or when determination is made that the status signal is larger than the control signal.

* * * * *